US007777116B2

(12) United States Patent
Luciani

(10) Patent No.: US 7,777,116 B2
(45) Date of Patent: Aug. 17, 2010

(54) METHOD USED TO TUNE AN ELECTRONIC ORGAN WITH ASSOCIATE AIR ORGAN PIPES

(75) Inventor: Rolando Luciani, Tavullia (IT)

(73) Assignee: Viscount International S.p.A., Mondaino, (RN) (IT)

( * ) Notice: Subject to any disclaimer, the term of this patent is extended or adjusted under 35 U.S.C. 154(b) by 274 days.

(21) Appl. No.: 12/083,578

(22) PCT Filed: Jan. 23, 2006

(86) PCT No.: PCT/IT2006/000035

§ 371 (c)(1),
(2), (4) Date: Apr. 15, 2008

(87) PCT Pub. No.: WO2007/046119

PCT Pub. Date: Apr. 26, 2007

(65) Prior Publication Data

US 2009/0229446 A1 Sep. 17, 2009

(30) Foreign Application Priority Data

Oct. 17, 2005 (IT) ..... MC2005A0111

(51) Int. Cl.
*G10G 7/02* (2006.01)

(52) U.S. Cl. ..... 84/456; 84/454; 84/600

(58) Field of Classification Search ..... 84/454–457, 84/600–602

See application file for complete search history.

(56) References Cited

U.S. PATENT DOCUMENTS

| | | | | |
|---|---|---|---|---|
| 4,303,000 | A * | 12/1981 | Peterson | 84/346 |
| 4,350,073 | A * | 9/1982 | Peterson | 84/672 |
| 7,005,571 | B1 * | 2/2006 | Groff | 84/645 |
| 7,626,104 | B2 * | 12/2009 | Scriba et al. | 84/331 |
| 2002/0117042 | A1 * | 8/2002 | Light et al. | 84/478 |
| 2008/0022838 | A1 * | 1/2008 | Scriba et al. | 84/337 |
| 2008/0216638 | A1 * | 9/2008 | Hustig | 84/645 |
| 2009/0229446 | A1 * | 9/2009 | Luciani | 84/456 |
| 2009/0241753 | A1 * | 10/2009 | Mann | 84/384 |

* cited by examiner

*Primary Examiner*—David S. Warren
(74) *Attorney, Agent, or Firm*—Hodes, Pessin, & Katz, P.A.

(57) ABSTRACT

The present invention refers to a method used to automatically tune, thanks to the presence of a suitably designed electronic device, an electronic organ with the air organ pipes associated with it; it being provided, in particular, that the said operation is performed based on the tuning variations detected in real time on the air pipes based on parameters referring to the frequency of the emitted sound and to environmental temperature.

10 Claims, 4 Drawing Sheets

METHOD USED TO TUNE AN ELECTRONIC ORGAN WITH ASSOCIATE AIR ORGAN PIPES

The present patent application relates to a method used to tune an electronic organ with air organ pipes, together with the electronic device used to implement the said method.

As it is known, the use of a liturgical electronic organ—which is advantageously characterised by lower purchase price and easier maintenance compared to traditional pipe organs—in combination with the pipes of a pre-existing traditional electromechanical organ or with expressly installed air pipes is getting more and more popular in churches, theatres and concert halls.

The reason for combining a modern electronic organ with traditional air pipes is that air pipes complete the sound of the electronic organ in a very fascinating way.

However, such a combination (that is to say the generation of electronic sounds together with the sound generated by traditional air pipes) is impaired by a considerable drawback, in spite of combining the advantages of the two pre-existing technologies.

The said inconvenience is related to the difficult tuning of the electronic organ and the air pipes sound with one voice.

This is due to the fact that electronic sounds are mathematically exact and insensible to atmospheric agents, while air pipes, being made of metals that are sensitive to temperature and environmental humidity, vary the timbre and frequency of their vibration according to the said agents.

The result of these "variations" in the sounds produced by the air pipes is that the sound obtained in combination with the sound of an electronic organ, is "out of tune", with a considerably negative general effect.

So far this problem has been solved with the attempt to adjust the intonation of the sounds produced by the electronic organ with the intonation of the sounds produced by the air pipes in real time.

This is the only possible solution, it being impossible to perform the opposite operation (that is to say to adjust the sounds of air pipes to the sounds of the electronic organ), since, in such a case, specific, complex calibration of each air pipe associated with the electrical organ is required.

However, the adjustment of the sound of the electronic organ to the sound of the air pipes is not completely satisfactory, since it is basically carried out "by ear", also considering that such an operation is very difficult to perform, especially during the execution of a difficult musical piece.

The poor efficacy of the said operation has forced experts to devise a method used to automatically modify the intonation of an electronic organ to adjust it to the sound of air pipes.

Within this context, it has been empirically ascertained that temperature variations deteriorate the intonation of air pipes in a basically uniform way.

In other words, it has been demonstrated that when temperature changes, air pipes in the same set raise or lower intonation in the same way.

Moreover, the effect of a specific temperature variation on the intonation of the air pipes has been empirically verified.

Starting from this empirical data, a system has been devised to continuously monitor the temperature of air pipes; with experimental measurements and average values, it has been established that the increase of one centigrade degree corresponds to an increase of 2.2 to 2.5 hundredths of half-tone.

By knowing the temperature variation on the intonation of air pipes, the intonation of the sounds generated by the electronic organ can be modified consequently.

This method is rather popular, also in view of its simple execution mode.

In fact, instruments able to convert temperature detection into electrical information are popular and inexpensive; electrical information is easily converted into digital information to be transmitted to the electronic organ using the organ Midi interface or other simple methods.

However, it must be noted that this traditional method is rather approximate, since the "temperature to frequency" conversion tables are the result of generic measurements and not the result of a specific situation monitored in real time; moreover, they do not consider other parameters that affect the frequency of the air pipe sounds, such as humidity and air pressure which can vary according to multiple factors based on different constructive characteristics.

The specific purpose of the invention is to devise a method capable of overcoming the said inconveniences of the prior technique, based on a totally innovative, practical and efficacious solution.

As a matter of fact, for the first time the method of the invention uses two different parameters detected in the same set of air pipes to adjust the sound of the electronic organ to the sound of the air pipes in real time.

The first parameter, which is also used in the prior technique, refers to temperature variations in the room where the set of air pipes is located.

The second parameter refers to the actual frequency of the sound of one or more pipes of the same set, it being provided that the frequency values are automatically detected every time the pipe or pipes that are being monitored start operating; this ensures a value updated in real time also during execution of a music piece.

For more information, it must be noted that the frequency parameter that is detected instantaneously in one or more pipes is the most direct, immediate and reliable parameter for prompt continuous tuning of the electronic organ.

However, the monitored pipes may remain silent (not being involved in the execution of music) for a few minutes; in such a case, prompt continuous tuning of the electronic organ would be impossible.

In order to fill this gap, the method of the invention also uses the environmental temperature parameter, which is continuously detected regardless of the fact that air pipes are playing or not.

In such a case, the electronic organ is tuned based on a temperature to frequency conversion table that is updated on a continuous basis with real temperature and frequency data.

Every time the frequency of the monitored pipes is detected, this parameter is not only used to tune the electronic organ; it is also used to update, second by second, the temperature to frequency conversion table used as reference to determine correct tuning of the organ, while the pipes that are monitored in terms of sound frequency are silent.

To highlight the peculiarities of the method of the invention compared to the prior technique, it must be noted that the temperature and frequency values used for the temperature to frequency conversion table are not estimated values since, for the first time, they are the result of continuous periodical measurement in real time.

Of course, this ensures that tuning of the electronic organ with the air pipes is no longer performed in an approximate way (based on presumptive standard parameters), it being performed with total accuracy and instantaneous "adjustments" based on the values measured, second by second, in the specific set of air pipes associated to the electronic organ.

This is confirmed by the fact that, until the pipe or pipes are actually operating, the parameter used to tune the organ (that is to say the specific frequency of the sound generated by the pipes) is a "direct and instantaneous" parameter characterised by total accuracy and reliability.

Moreover, it is confirmed by the fact that, while the monitored pipes are silent, the electronic organ is tuned based on a temperature to frequency conversion table that is constantly and promptly updated based on real instantaneous temperature and frequency values.

Within this new operating mode, it must be noted that the frequency of each air pipe is recorded by means of a device used to detect the sound of the pipe and discriminate it from the sound of adjacent pipes and background noise.

This function is suitably performed by a microphone installed at a short distance from the pipe to be monitored, by a contact microphone or a piezo-ceramic buzzer directly mounted against the metal surface of the pipe, or by an air flow sensor installed in useful position with respect to the cross section used for the passage of air in the pipe or by any suitable sensor.

For purposes of clarity the description of the invention continues with reference to the enclosed drawing, which is intended for purposes of illustration only and not in a limiting sense, whereby:

Figure 1:
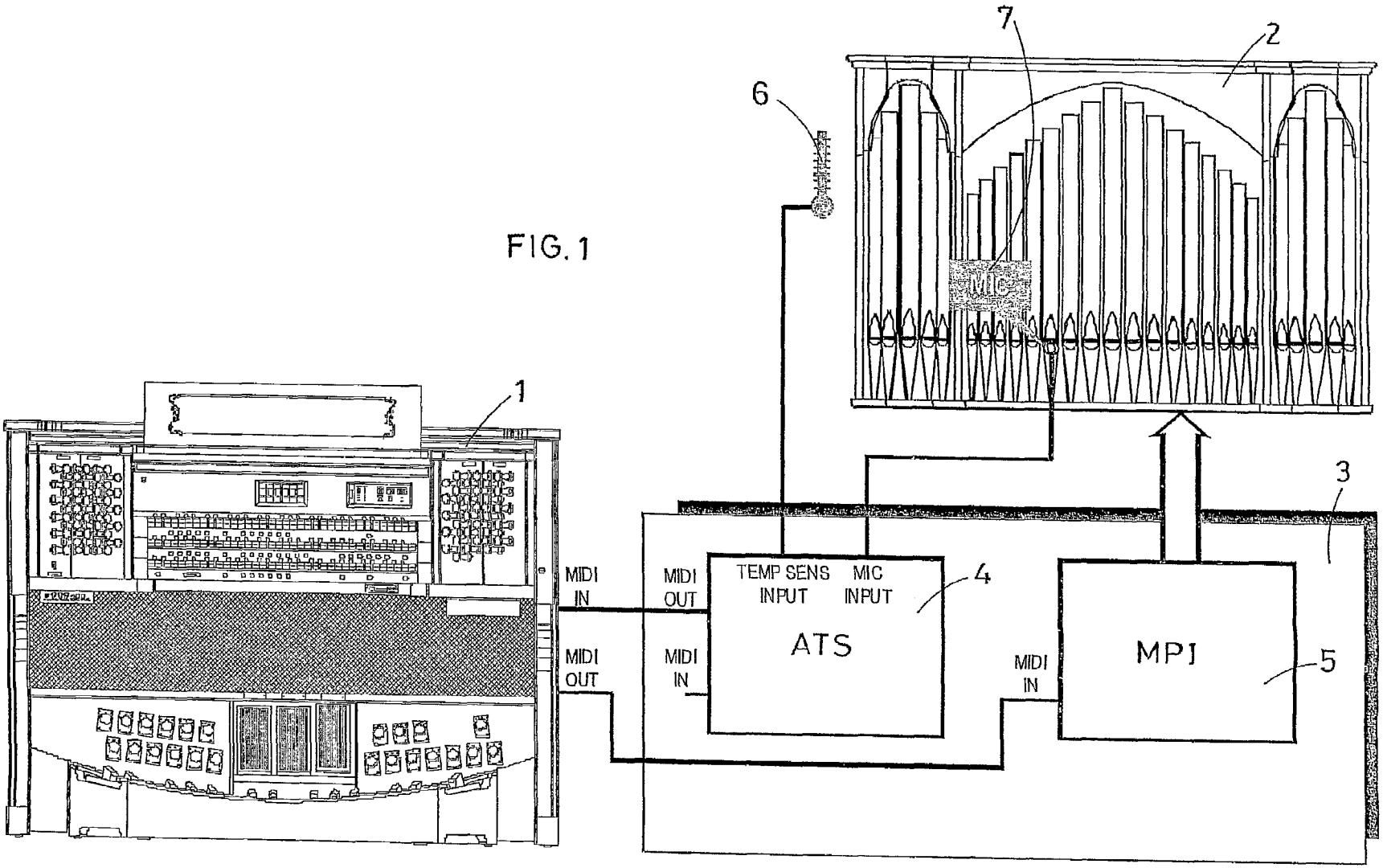
FIG. 1 is a block diagram that illustrates the devices used and their interaction for the implementation of the method of the invention.

With special reference to FIG. 1, the method of the invention is applied in the presence of an electronic organ (1) capable of activating a set of air pipes (2) by means of an interface used to convert Midi (Musical Instrument Digital Interface) codes of the keys pressed and registers activated into electrical commands used to control the electromagnetic valves of the pipes (2).

In particular, the organ (1) must be able to respond to a Midi code that determines tuning, just like the majority of modern electronic organs.

According to the method of the invention, the electronic organ (1) and the set of air pipes (2) interact by means of an electronic device (3), with an "Auto Tune System" block, hereinafter defined as ATS and indicated with numeral (4) in the enclosed figures, and a traditional "Midi Pipe Interface" block, hereinafter defined a MPI and indicated with numeral (5) in the enclosed figures.

In particular, the MPI (5), which uses a microprocessor that also provides the serial port according to the Midi standard, is responsible for converting the serial digital information from the organ (1) into electrical signals capable of controlling the electromagnetic valves of the air pipes (2).

This means that when the electronic organ (1) starts to play, the codes of the notes and registers are transmitted to the electronic devices (3) by means of the Midi port; in particular, the codes go to the ATS block (4) and to the MPI block (5), which in turn sends the information to the electromagnetic valve system that controls the air pipes (2), thus making the pipes that correspond to the notes and registers that are actually activated by the organ (1) play.

The fundamental role for the implementation of the method of the invention is however assigned to the ATS block (4).

For this purpose, it interacts with a temperature sensor (6) installed at a short distance from the set of air pipes (2) and with a device used to detect the sound (7), preferably a microphone, installed in suitable position on the air pipe (2).

The function of the temperature sensor (6) is to send the electrical information about the temperature detected in the proximity of the set of air pipes (2) to the ATS block (4), while the sound detector (7) sends the electrical signal of the sound generated by the air pipe. The ATS block is provided with a microprocessor that also provide for the serial port according to the Midi standard, and processes the temperature and sound electrical signals, thus automatically determining the sound frequency of the pipe on which it is installed.

Once signals are processed, the ATS block (4) sends the data in Midi format to the organ (1) that will instantaneously modify tuning based on this piece of information, including during the execution of the music piece.

As shown in FIG. 1, one microphone is applied to a specific air pipe, preferably the pipe of the most important register that corresponds to a central key of the keyboard, designed to be pressed with more frequency.

However, in order to improve the method of the invention, a plurality of sound detectors may be used, each of them being position on a pipe of the set (2), thus calculating the average value of frequency variations detected on the different pipes.

Following the general presentation of the method of the invention, this description continues with a detailed presentation of the technical implementation mode of the same method.

In order to measure the frequency value, the microphone (7) is used to detect the sound generated by a reference pipe, measuring the frequency accurately and repeating the measurement every time a monitored pipe is operated during the execution of the music piece, without interrupting the execution and without breaks between music pieces.

As soon as the air pipe associated with the microphone (7) starts playing, the signal is instantaneously sent to the ATS block (4); being provided with a sensing analogue section, the ATS block is started and measures the sound frequency.

The latter operation is performed with total accuracy because the microprocessor that controls it will activate measurement only when the sound has reached regular operation.

The microprocessor measures a high number of signal periods (not one single period, since it may prove unstable), and calculates the average value of the results, by dividing the total measurement by the number of measured periods.

Also the number of measured periods is calculated with very high accuracy, using the "zero crossing" measurement system and the measurement value is discarded if the sound duration does not guarantee the minimum quantity of periods necessary to ensure reliable measurement.

The measured frequency is converted into a tuning Midi code that is sent to the organ (1), which can read this piece of information and adjust intonation to the air pipes.

This is made automatically and in a transparent way for the musician.

The temperature to frequency conversion curve is obtained in the following way.

Figure 2:
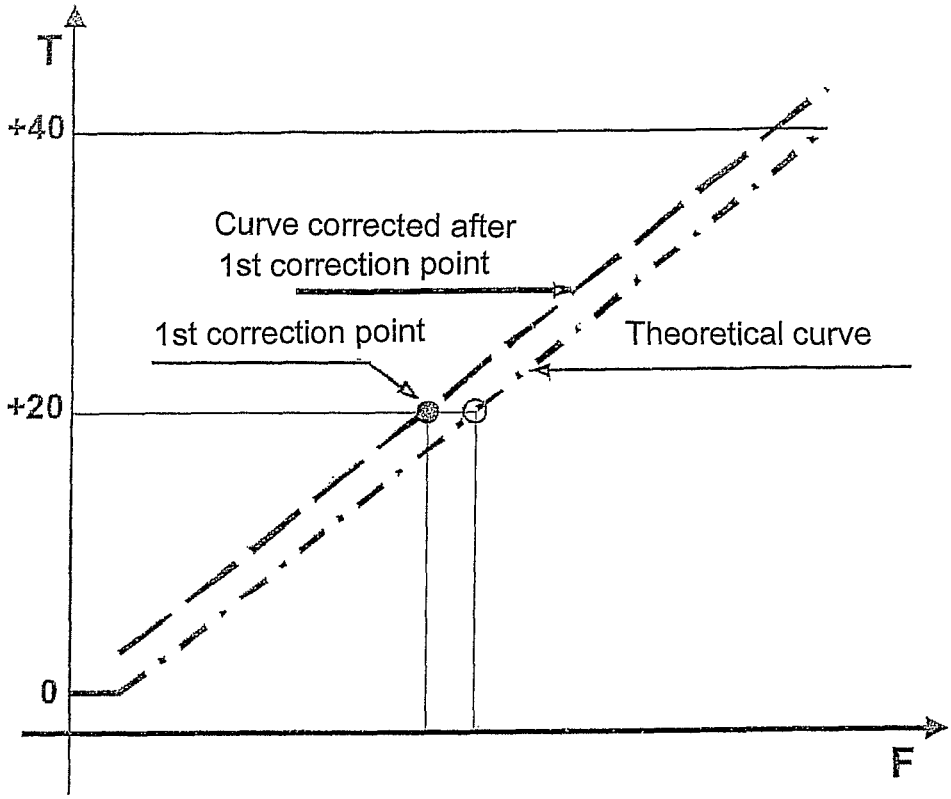
FIGS. 2, 3, 4 and 5 are block diagrams that illustrate the practical implementation modes of the method of the invention.

The calculation unit used in the ATS block (4) contains an estimated starting curve (shown with a dotted line in the diagram of FIG. 2).

Every time the unit measures the frequency by means of the microphone (7), in addition to sending the piece of tuning information to the organ, it also reads the temperature and includes the value in the temperature-frequency table, replacing the theoretical value with the real one.

The first time the device reads a "real" data, the data is included in the table and the line describing the temperature to frequency conversion is moved in order to pass through the said value while maintaining the same inclination; in particular, the line is shown as a dotted line in FIG. 2.

When a second frequency value is measured, the ATS block (4) sends the tuning information again to the organ (1) and simultaneously reads the current temperature value, including the second "real" data in the temperature to frequency conversion table.

Figure 3:
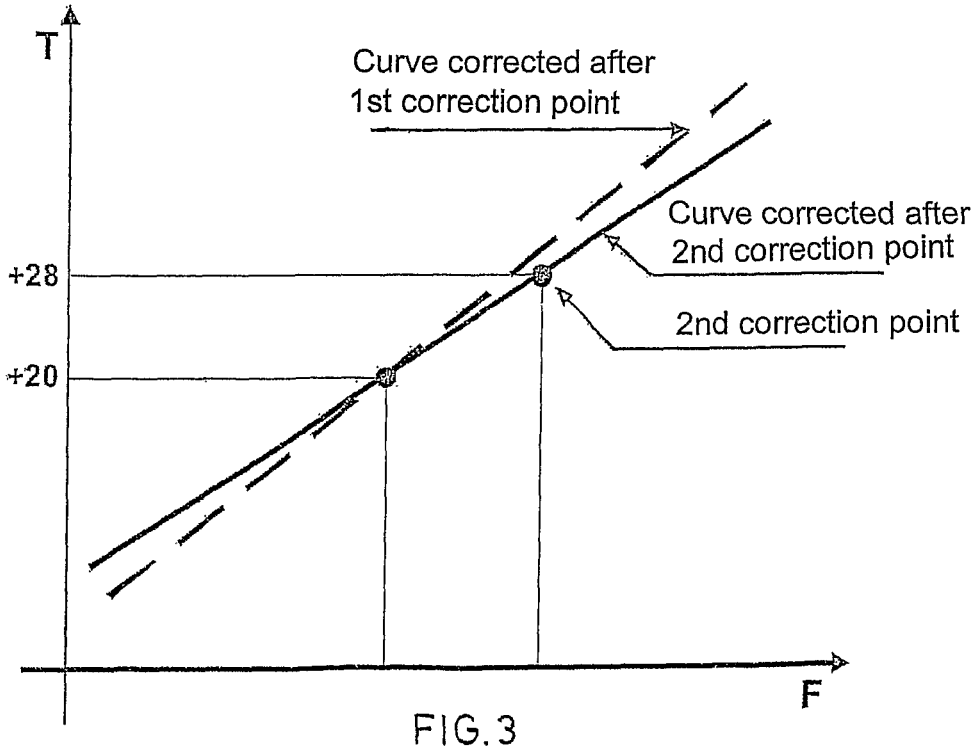

A second "real" piece of information allows to improve the accuracy of the line that will be modified in inclination to go through two "real" data; in the diagram of FIG. 3 the "modified" line is shown as a continuous line.

When a third frequency value is measured, the ATS block (4) sends the tuning information again to the organ (1) and simultaneously reads the current temperature value, including the third "real" data in the temperature to frequency conversion table.

Figure 4:
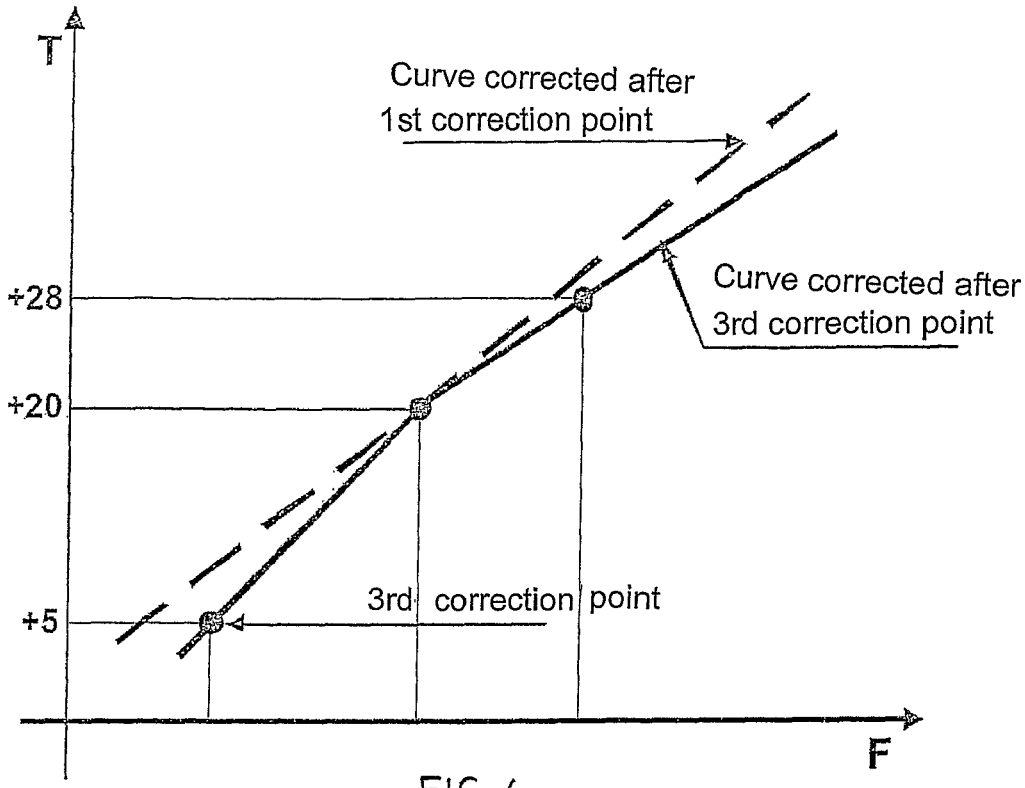

The third "real" piece of information allows to further improve the accuracy of the response curve that is modified to go through the three "real" data, thus assuming a direction other than rectilinear, as shown in diagram of FIG. 4.

Figure 5:
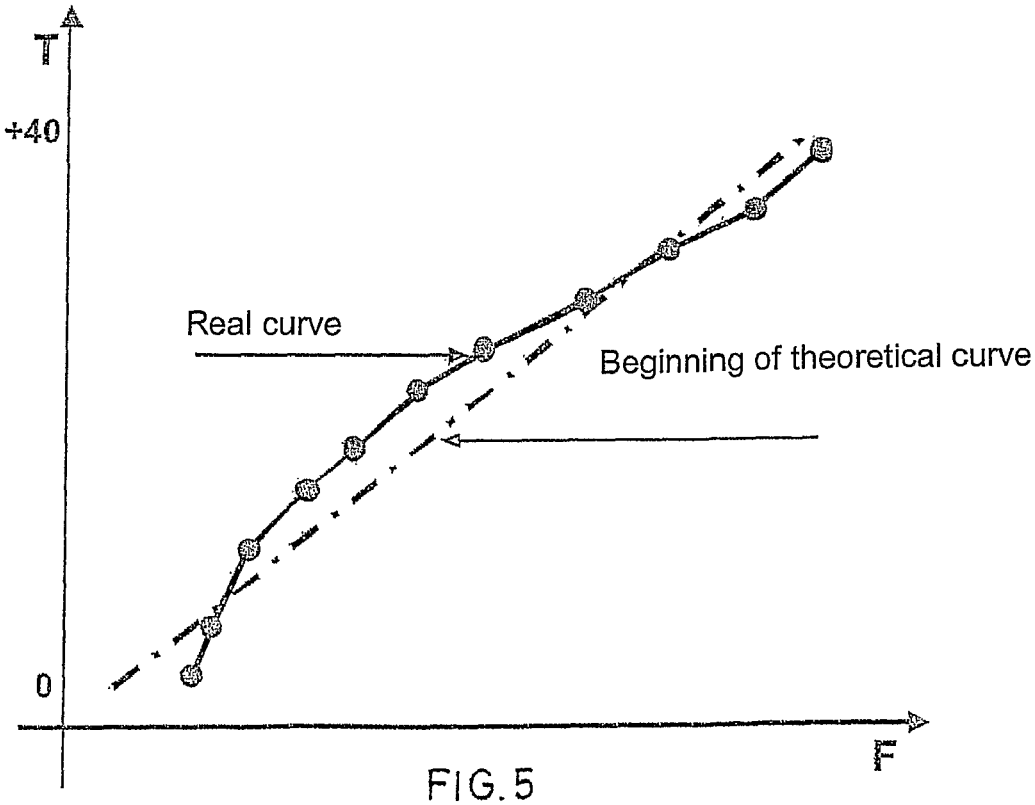

After multiple measurements and corrections, the real response curve is described in different points and has a more or less complex direction according to the actual conditions, as shown in the diagram of FIG. 5.

The updating process is endless; as a matter of fact, every time the ATS block (4) is in operation, the data is updated in consistency with the real situation.

In this way, regardless of its origin, the tuning information transmitted by the circuit to the organ (1)—calculated by measuring the frequency of the sample pipe or extracted by the temperature to frequency conversion table—is always exact and real, and never approximate or estimated.

Figure 6:
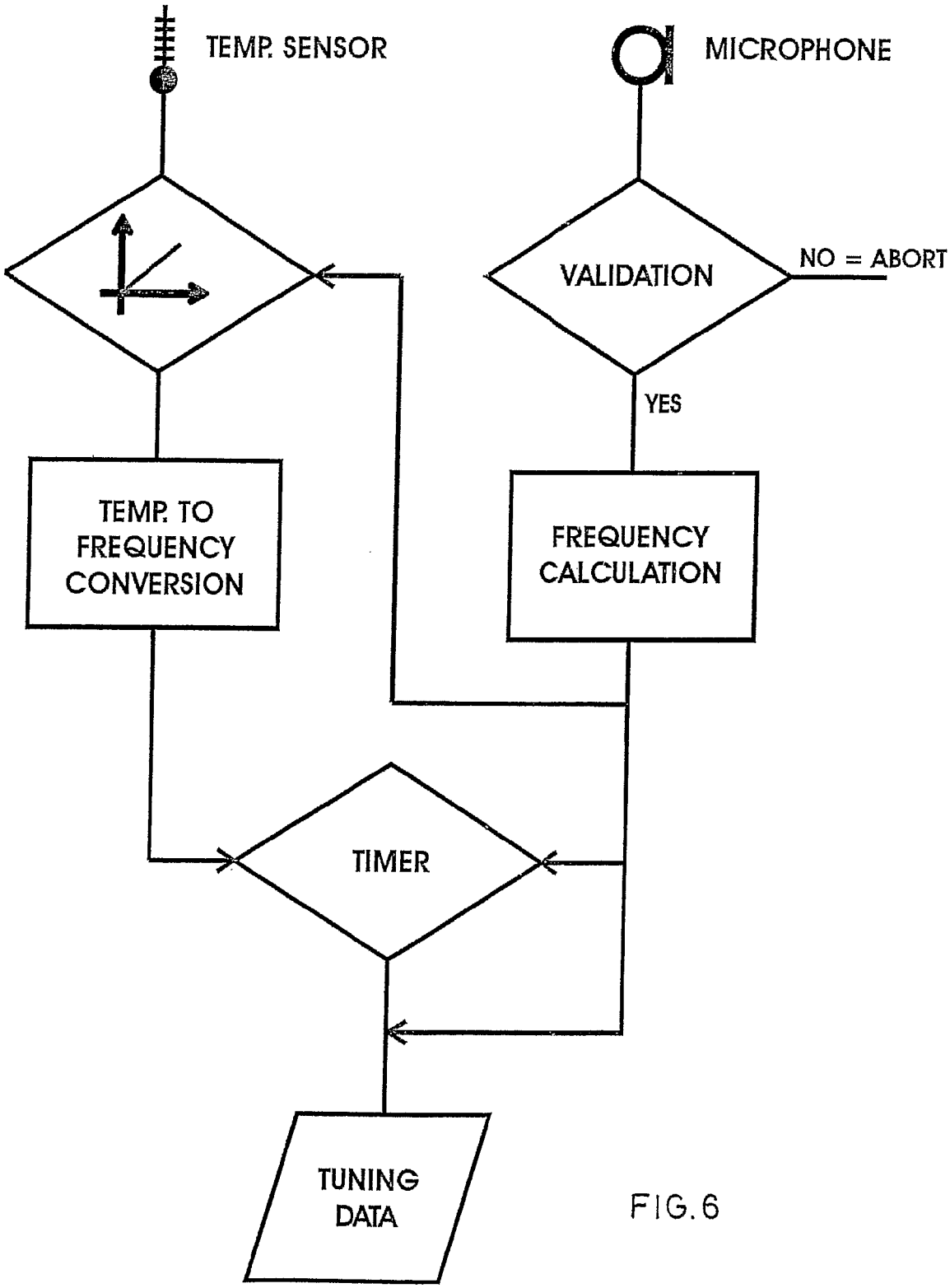
FIG. 6 is a flow diagram that illustrates the operative logics on which the present invention is based.

As shown in the flow diagram of FIG. 6, between the two source of information, the frequency measurement is a priority compared to the one of the temperature to frequency conversion table.

The specific function of the diagram shown in FIG. 6 is to diagrammatically illustrate the operative sequence determined in the ATS block (4) by the CPU.

The microphone associated with a specific air pipe sends the detected sound information to the ATS block (4), in which it is validated to ascertain that it has the certainty (meaning that the sound is originally and safely originated by the specific air pipe being monitored) and stability (meaning the reliability of the sound as reference parameter) requirements.

If these requirements are not complied with, the sound data is aborted; if the said requirements are complied with, the data is processed to measure the frequency value (frequency calculation).

The frequency value is used as "tuning data" by the ATS block (4) to adjust the intonation of the electronic organ (1).

Simultaneously, the data is also used to constantly update the temperature to frequency conversion table, which also includes the environmental temperature data measured by the temperature sensor when the frequency is measured.

The transmission of data on multiple frequency measurement is managed by a timer, which also receives data extracted from the said temperature to frequency conversion table.

In this way, the timer can determine whether the monitored pipe has not played during a pre-established period of time—preferably between 1 and 5 minutes—and therefore has not produced data on its specific frequency.

Since the electronic organ needs to instantaneously receive updated data on frequency variations of the air pipes, when direct frequency data is not measured by the microphone, the timer is activated to send the tuning code extracted from the temperature to frequency conversion table to the organ.

Finally, it must be said that—assuming that frequency values are measured based on temperature variation every five minutes—if a new frequency measurement of the sound is detected after four minutes from the transmission of the last tuning data (deriving from the frequency measurement), the last piece of information is immediately sent to the organ for a new tuning operation.

The timer used to send tuning information based on the temperature is reset to restart the 5-minute time limit measurement.

The invention claimed is:

1. Method used to tune an electronic organ with associated air pipes, of the type that makes use of an MPI block (5) for the MIDI serial port that converts serial digital data from the organ (1) into electrical signals used to control electromagnetic valves of the air pipes (2), characterized in that it also provides for:

providing a temperature sensor (6) in the proximity of a set of air pipes (2) and providing a sound detector (7) in one of the air pipes, both the temperature sensor (6) and the sound detector (7) interfaced with an ATS block (4) together with the MPI block (5) in an electronic device positioned between the set of air pipes (2) and the electronic organ (1);

transmitting electrical information from the sound detector (7) to the ATS block (4) related to the sound generated by the corresponding air pipe when used during the execution of a music piece;

transmitting electrical information from the temperature detector (6) to the ATS block (4) related to the temperature detected in the proximity of the set of air pipes (2);

validating and processing of the electrical signal related to the sound of the air pipe by the ATS block (4) to determine frequency;

use of the sound frequency value, in combination with the value of the temperature detected by the sensor (6) in order to create a temperature to frequency conversion table in real time timing of the sound frequency value by a timer provided in the ATS block (4) and sorting of the sound frequency value by the timer, after suitable conversion into a MIDI code towards the electronic organ (1) for tuning purposes;

transmitting of data extracted from the frequency to temperature conversion table towards the timer that converts it said data into MIDI code and sends said data to the electronic organ (1) to tune the organ (1), if data about the frequency detected in the specific air pipe has not been received for a pre-established period of time; and automatically resetting of the timer, with consequence reset of calculation of the pre-established time period every time the timer receives the frequency value detected in the air pipe being monitored.

2. Method as defined in claim 1, characterized in that the validation of the electrical information on the sound detected in the air pipe consists in verifying whether the information has certainty and stability requirements.

3. Method as defined in claim 2, characterized in that the stability of the electrical information about the sound is verified by a microprocessor provided in the ATS block (4), which measures a high number of sound periods and then averages the result dividing the total measurement by the number of evaluated periods; it being provided that the latter data about the actually evaluated periods is obtained by using the "zero crossing" system and therefore discarding the measurement if the sound duration does not guarantee a minimum quantity of periods suitable to obtain reliable information.

4. Method as defined in claim 1, characterized in that there are multiple identical sound detectors, each associated with a respective air pipe; it being provided, in this case, that the electrical information to be processed by the ATS block (4) to detect the sound frequency is obtained by averaging the frequency variations detected on the various air pipes.

5. Method as defined in claim 1, characterized in that the temperature to frequency conversion table is obtained in the following way:

preparing an estimated starting curve in a calculation unit used by the ATS block (4);

every time the unit measures the frequency by means of the microphone (7), in addition to sending the tuning information to the organ, the unit also reads the current temperature and includes the value in the temperature to frequency table, replacing the theoretical value with the real one;

the first time the device reads a "real" data, the data is included in the table and the line describing the temperature to frequency conversion is moved in order to pass through the said value while maintaining the same inclination;

when a second frequency value is measured, the ATS block (4) sends the tuning information again to the organ (1) and simultaneously reads the current temperature value in that exact moment, including the second "real" data in the temperature to frequency conversion table;

a second "real" piece of information improves the accuracy of the line that will be modified in inclination to go through the two "real" data;

when the third frequency value is measured, the ATS block (4) sends the tuning information again to the organ (1) and simultaneously reads the current temperature value, including the third "real" data in the temperature to frequency conversion table the third "real" piece of information further improves the accuracy of the response curve that will be modified to go through the three "real" data, thus assuming a new direction after multiple measurements and corrections, the real response curve is described in different points and has a specific direction according to the actual conditions; and it being provided that the updating process is endless, meaning that data is updated every time the ATS block (4) is maintained in operation.

6. Method as defined in claim 1, wherein the ATS block (4) is an electronic device capable of automatically managing the operations of the electronic organ.

7. Method as defined in claim 6, characterized in that the sound detector (7) that cooperates with the ATS block (4) consists in a microphone installed in the proximity of the air pipe to be monitored.

8. Method as defined in claim 6, characterised in that the sound detector (7) that cooperates with the ATS block (4) consists in a microphone installed in direct contact with the air pipe to be monitored.

9. Method as defined in claim 6, characterized in that the sound detector (7) that cooperates with the ATS block (4) consists in a piezo-electric buzzer directly installed on the air pipe to be monitored.

10. Method as defined in claim 6, characterized in that the sound detector (7) that cooperates with the ATS block (4) consists in a sensor used to detect the air flow emitted by the air pipe to be monitored.

* * * * *